US007987894B2

(12) United States Patent
Chan et al.

(10) Patent No.: US 7,987,894 B2
(45) **Date of Patent: *Aug. 2, 2011**

(54) APPARATUS FOR MAKING MAGNESIUM-BASED CARBON NANOTUBE COMPOSITE MATERIAL AND METHOD FOR MAKING THE SAME

(75) Inventors: Kam-Shau Chan, Taipei Hsien (TW); Cheng-Shi Chen, Taipei Hsien (TW); Guang-Liang Sheu, Taipei Hsien (TW); Qing-Chun Du, Shenzhen (CN); Wen-Zhen Li, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 264 days.

This patent is subject to a terminal disclaimer.

(21) Appl. No.: 12/195,852

(22) Filed: Aug. 21, 2008

(65) Prior Publication Data

US 2009/0057957 A1 Mar. 5, 2009

(30) Foreign Application Priority Data

Aug. 31, 2007 (CN) ..... 2007 1 0076768

(51) Int. Cl.
*B22D 19/14* (2006.01)
*B22D 17/00* (2006.01)

(52) U.S. Cl. ..... 164/97; 164/113; 164/900

(58) Field of Classification Search ..... 164/97, 164/113, 900; 977/742
See application file for complete search history.

(56) References Cited

U.S. PATENT DOCUMENTS

| | | | | |
|---|---|---|---|---|
| 6,546,991 | B2 * | 4/2003 | Dworog et al. | 164/113 |
| 6,860,314 | B1 * | 3/2005 | Koide et al. | 164/113 |
| 6,860,316 | B2 * | 3/2005 | Wu et al. | 164/312 |
| 7,712,512 | B2 * | 5/2010 | Suganuma et al. | 164/113 |
| 7,824,461 | B2 * | 11/2010 | Chan et al. | 75/10.13 |
| 2009/0056499 | A1 * | 3/2009 | Chan et al. | 75/10.67 |
| 2009/0127743 | A1 * | 5/2009 | Chan et al. | 264/294 |

FOREIGN PATENT DOCUMENTS

TW I264359 10/2006

OTHER PUBLICATIONS

"Powder Injection Moulding Technology for NdFeB Magnets", Die & Mould Industry, Xie Jian, No. 6, p. 35-39(2005).

* cited by examiner

*Primary Examiner* — Kevin P Kerns
(74) *Attorney, Agent, or Firm* — D. Austin Bonderer

(57) ABSTRACT

An apparatus for fabrication of a magnesium-based carbon nanotube composite material, the apparatus includes a thixomolding machine, and a feeding device. The thixomolding machine includes a heating barrel, a feeding inlet, a nozzle, a heating portion, and a plunger. The heating barrel includes a first end and a second end. The feeding inlet is disposed at the first end. The nozzle is disposed at the second end. The heating portion is disposed around the heating barrel. The plunger is disposed at a center of the heating barrel. The feeding device includes a hopper; an aspirator connected to the hopper, a first container, and a second container. The hopper is in communication with the first container and the second container. A method for fabricating a magnesium-based carbon nanotube composite material is also provided.

20 Claims, 2 Drawing Sheets

APPARATUS FOR MAKING MAGNESIUM-BASED CARBON NANOTUBE COMPOSITE MATERIAL AND METHOD FOR MAKING THE SAME

BACKGROUND

1. Field of the Invention

The present invention relates to apparatuses for fabricating composite materials and methods of fabrication for the same, and, particularly, to an apparatus for fabrication of a magnesium-based carbon nanotube composite material and a method of fabrication for the same.

2. Discussion of Related Art

Nowadays, various alloys have been developed for special applications. Among these alloys, magnesium-based alloys have relatively superior mechanical properties, such as good wear resistance, and high elastic modulus. Generally, two kinds of magnesium-based alloys have been developed: casting magnesium-based alloy and wrought magnesium-based alloy. However, the toughness and the strength of the magnesium-based alloys are not able to meet the increasing needs of the automotive and aerospace industries for tougher and stronger alloys.

To address the above-described problems, magnesium-based composite materials have been developed. In magnesium-based composite materials, nanoscale reinforcements (e.g. carbon nanotubes and carbon nanofibers) are mixed with magnesium metal or alloy. The most common methods for making magnesium-based composite materials are through thixomolding and die-casting. However, in die-casting, the magnesium or magnesium-based alloys are easily oxidized. In thixomolding, the nanoscale reinforcements are added to melted metal or alloy and are prone to aggregate. As such, the nanoscale reinforcements can't be well dispersed.

What is needed, therefore, is to provide an apparatus for fabrication of a magnesium-based carbon nanotube composite material and a method of fabrication for the same, in which the above problems are eliminated or at least alleviated.

SUMMARY

In one embodiment, an apparatus for fabrication of a magnesium-based carbon nanotube composite material, the apparatus includes a thixomolding machine, a die disposed near to the nozzle of the thixomolding machine, and a feeding device. The thixomolding machine includes a heating barrel, a feeding inlet, a nozzle, a heating portion, and a plunger. The heating barrel includes a first end and a second end. The feeding inlet is disposed at the first end. The nozzle is disposed at the second end. The heating portion is disposed around the heating barrel. The plunger is disposed at a center of the heating barrel. The feeding device includes a hopper; an aspirator connected to the hopper, a first container, and a second container. The hopper is in communication with the first container and the second container.

Other advantages and novel features of the present apparatus for fabrication of a magnesium-based carbon nanotube composite material and a method of fabrication for the same will become more apparent from the following detailed description of preferred embodiments when taken in conjunction with the accompanying drawings.

BRIEF DESCRIPTION OF THE DRAWINGS

Many aspects of the present apparatus for fabrication of a magnesium-based carbon nanotube composite material and a method of fabrication for the same can be better understood with reference to the following drawings. The components in the drawings are not necessarily to scale, the emphasis instead being placed upon clearly illustrating the principles of the present apparatus for fabrication of a magnesium-based carbon nanotube composite material and a method of fabrication for the same.

Figure 1:
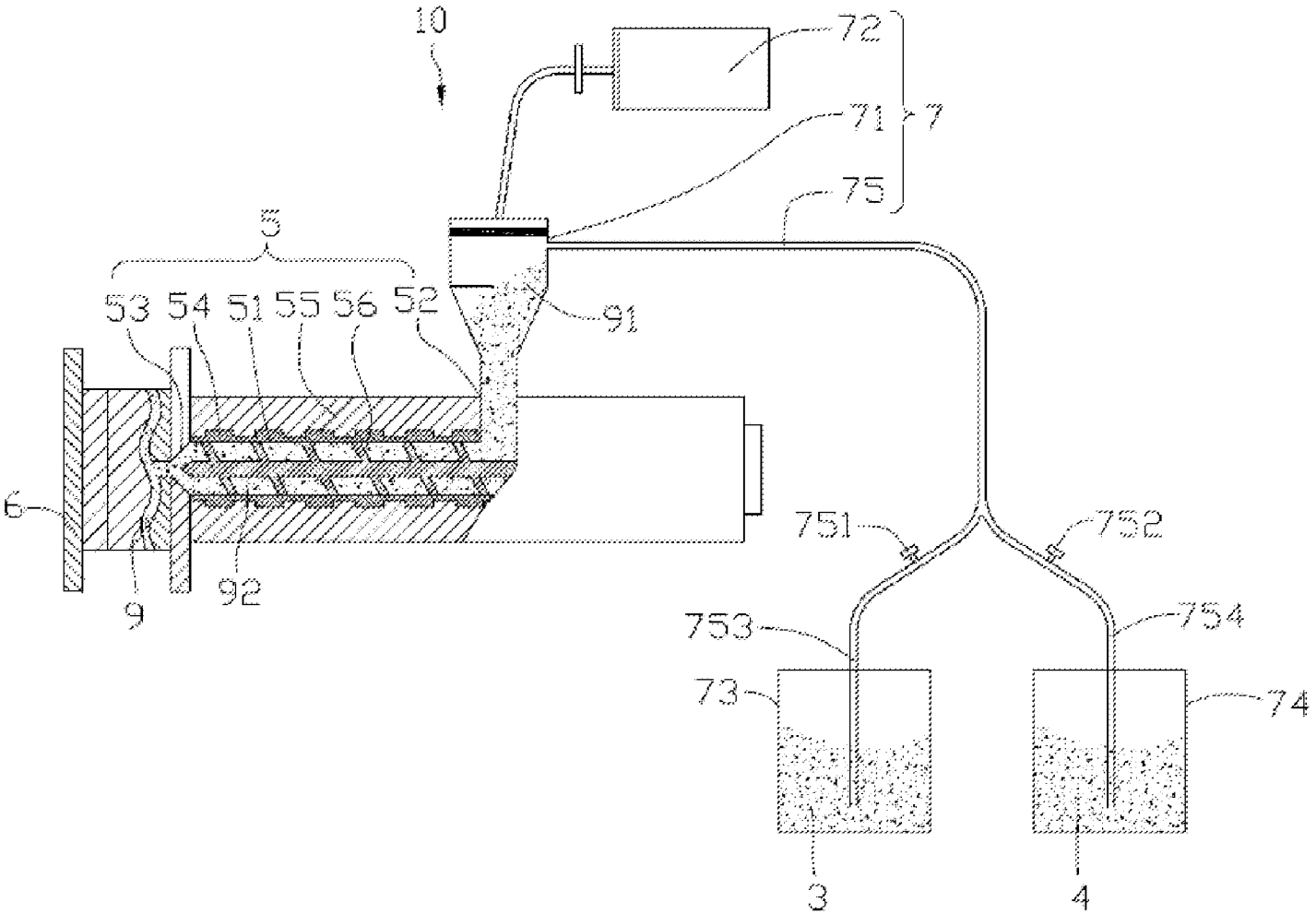
FIG. 1 is a schematic view of an apparatus for fabrication of a magnesium-based carbon nanotube composite material, in accordance with the present embodiment.

Corresponding reference characters indicate corresponding parts throughout the several views. The exemplifications set out herein illustrate at least one embodiment of the present apparatus for fabrication of a magnesium-based carbon nanotube composite material and a method of fabrication for the same, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the present apparatus for fabrication of a magnesium-based carbon nanotube composite material and a method of fabrication for the same.

Referring to FIG. 1, an apparatus 10 for fabrication of a magnesium-based carbon nanotube composite material 9 includes a thixomolding machine 5, a die 6, and a feeding device 7.

The thixomolding machine 5 includes a heating barrel 51, a feeding inlet 52, a nozzle 53, a heating portion 54, and a plunger/auger 56. The heating barrel 51 includes a first end and a second end opposite to the first end. The feeding inlet 52 is disposed at the first end of the heating barrel 51. The nozzle 53 is disposed at the second end of the heating barrel 51. The die 6 is disposed close to the nozzle 53 of the thixomolding machine 5. The heating portion 54 is disposed around an outer wall of the heating barrel 51. A cover/insulator 55 for heat preservation can be further disposed outside the heating portion 54 to provide a steady temperature in the heating barrel 51. The plunger 56 is disposed in a center of the heating barrel 51 and can revolve therein.

The feeding device 7 can include a hopper 71, an aspirator 72, a first container 73, a second container 74, and a feeding tube 75. The hopper 71 is disposed on the feeding inlet 52. The aspirator 72 is connected to the hopper 71. The feeding tube 75 connects the hopper 71 with the first container 73 and the second container 74. A large amount of magnesium containing particles 3 is put in the first container 73. A large amount of carbon nanotubes 4 is put in the second container 74. The aspirator 72 evacuates the air in the hopper 71. And thus, the magnesium containing particles 3 and the carbon nanotubes 4 are suctioned into the hopper 71 due to the vacuum.

In the present embodiment, the aspirator 72 is a vacuum pump; the feeding tube 75 is Y-shaped. The Y-shaped feeding tube 75 includes a first branch 753 connected to the first container 73 and a second branch 754 connected to the second container 74. A first valve 751 is disposed on the first branch 753 to help control the flow of the magnesium containing particles 3. A second valve 752 is disposed on the second branch 754 to help control the flow of the carbon nanotubes 4.

Figure 2:
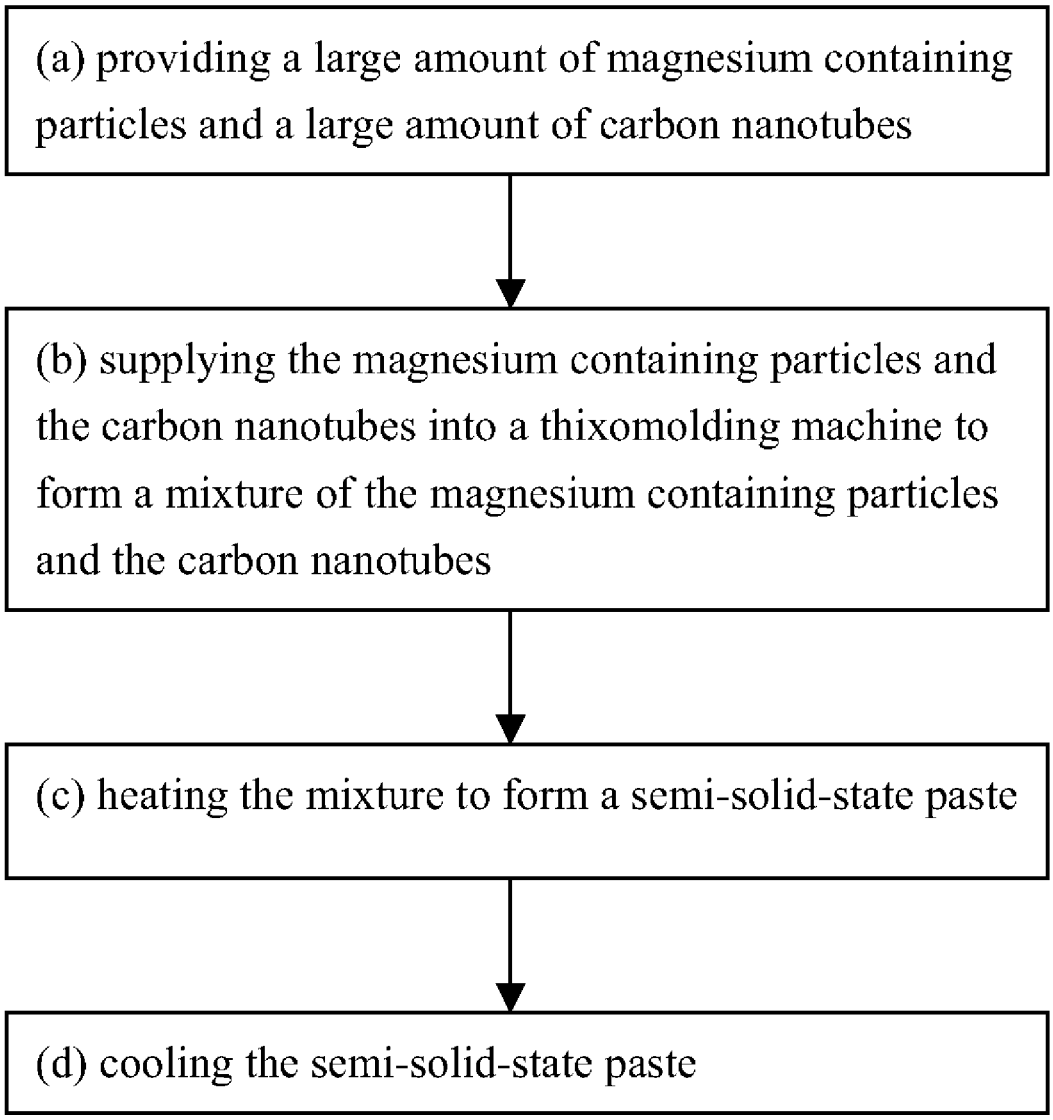
FIG. 2 is a flow chart of a method for fabrication of the magnesium-based carbon nanotube composite material, in accordance with a present embodiment.

Referring to FIG. 2, a method of fabrication for the magnesium-based carbon nanotube composite material 9 includes the steps of: (a) providing a large amount of magnesium containing particles 3 disposed in the first container 73 and a large amount of carbon nanotubes 4 disposed in the second container 74; (b) suctioning the magnesium containing particles 3 and the carbon nanotubes 4 into the thixomolding machine 5 by using the aspirator 72 to create a vacuum to form a mixture 91 of the magnesium containing particles 3 and the carbon nanotubes 4; (c) heating and continuing to mix the mixture 91 of the magnesium containing particles 3 and the carbon nanotubes 4 to form a semi-solid-state paste 92; and (d) cooling the semi-solid-state paste 92.

In step (a), the magnesium containing particles 3 are made of magnesium metal or magnesium-based alloys. The magnesium-based alloys include magnesium and other elements selected from a group comprising of zinc (Zn), manganese (Mn), aluminum (Al), zirconium (Zr), thorium (Th), lithium (Li), silver, calcium (Ca), and any combination thereof. A mass ratio of the magnesium metal to the other elements can be more than 4:1. A diameter of the magnesium containing particles 3 can be in the approximate range from 20 nanometers to 100 microns.

The carbon nanotubes 4 can be selected from a group comprising of single-wall carbon nanotubes, double-wall carbon nanotubes, multi-wall carbon nanotubes, and combinations thereof. A diameter of the carbon nanotubes 4 can be in the approximate range from 1 to 150 nanometers. A length of the carbon nanotubes 4 can be in the approximate range from 1 to 10 microns. A mass ratio of the carbon nanotubes 4 to the magnesium containing particles 3 can be in the approximate range from 1:50 to 1:200.

In step (b), the magnesium containing particles 3 and the carbon nanotubes 4 are firstly suctioned into the hopper 71 to form the mixture 91. The introduction of the magnesium 3 and the carbon nanotubes 4 at the same time and in this manner provide for a good mixing of the two elements. In other embodiments, other materials can be added to the hopper 71 in the same manner. After that, the mixture 91 is transferred to the heating barrel 51 of the thixomolding machine 5 through the feeding inlet 52. The magnesium containing particles 3 and the carbon nanotubes 4 are suctioned into the hopper 71 at the same time by opening the first valve 751 and the second valve 752 at the same time. The air pressure in the hopper 71 will control the flow of the magnesium containing particles 3 and the carbon nanotubes 4. The air pressure in the hopper 71 is controlled by the aspirator 72. The flow of the magnesium containing particles 3 and the carbon nanotubes 4 is partially controlled by the first valve 751 and the second valve 752, to provide enough mixture 91 for the thixomolding machine 5, and prevent an over accumulation in the hopper 71. The magnesium containing particles 3 and the carbon nanotubes 4 are suctioned into the hopper 71 controlled by the aspirator 72 to prevent segregation of the mixture 91. The suction method provides a good premixing of the carbon nanotues 4 and the magnesium containing particles 3.

In step (c), the mixture 91 of the carbon nanotubes 4 and the magnesium containing particles 3 are heated in the heating barrel 51 by the heating portion 54. The heating barrel 51 is kept at a pre-determined temperature by the heating portion 54. The mixture 91 is heated at the pre-determined temperature to change it into the semi-solid-state paste 92. The heating barrel 51 is filled with a protective gas. The protective gas can be nitrogen ($N_2$) or a noble gas. The plunger 56 is disposed in the center of the heating barrel 51 and can revolve therein. The plunger 56 also provides for additional mixing. The semi-solid-state paste 92 is stirred by the plunger 56. As such, the carbon nanotubes can be well dispersed in the semi-solid-state paste 92.

In step (d), the semi-solid-state paste 92 can be injected into a die 71. In the present embodiment, in step (d), at an elevated temperature, the semi-solid-state paste 92 is driven to the nozzle 53 by a revolving force of the plunger 56, and injected into the die 6. The rotation of the plunger 56 can be altered by speed and direction. It is to be understood that the method for driving the semi-solid-state paste 92 to the nozzle 53 is not limited to the above-mentioned method, but any suitable method known in the art.

In step (d), after being cooled, the magnesium-based carbon nanotube composite material 9 can be achieved. Then, the magnesium-based carbon nanotube composite material 9 is removed from the die 6.

The carbon nanotubes are well dispersed in the magnesium-based carbon nanotube composite material 9 due to the premixing step in step (b) and the stirring step in step (c). The achieved magnesium-based carbon nanotube composite material 9 is strong, and tough, and has a high density, and can be widely used in a variety of fields such as the automotive and aerospace industries.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that above description and the claims drawn to a method may include some indication in reference to certain steps. However, the indication used is only to be viewed for identification purposes and not as a suggestion as to an order for the steps.

What is claimed is:

1. A method of fabricating a magnesium-based carbon nanotube composite material, the method comprising:

providing magnesium containing particles and carbon nanotubes, a thixomolding machine and a feeding device;

mixing the magnesium containing particles and the carbon nanotubes outside the thixomolding machine by the feeding device;

forming a mixture of the magnesium containing particles and the carbon nanotubes outside the thixomolding machine, wherein the magnesium containing particles are all solid particles when mixing with the carbon nanotubes;

supplying the mixture into the thixomolding machine after the steps of mixing the magnesium containing particles and the carbon nanotubes by the feeding device and forming the mixture of the magnesium containing particles and the carbon nanotubes;

heating the mixture to form a semi-solid-state paste; and cooling the semi-solid-state paste.

2. The method as claimed in claim 1, wherein the step of mixing comprises suctioning the carbon nanotubes and the magnesium containing particles into one and the same hopper of the feeding device, the hopper being disposed on a feeding inlet of the thixomolding machine, the mixture is transferred to a heating barrel of the thixomolding machine through the feeding inlet.

3. The method as claimed in claim 2, wherein the magnesium containing particles and carbon nanotubes are suctioned to go through a Y shaped feeding tube and mixed in the Y shaped feeding tube.

4. The method as claimed in claim 2, wherein the magnesium containing particles are suctioned to go from a first container into the hopper, and the carbon nanotubes are suctioned to go from a second container into the hopper.

5. The method as claimed in claim 4, wherein the magnesium containing particles and carbon nanotubes are suctioned to go through a Y shaped feeding tube connecting the hopper with the first container and the second container.

6. The method as claimed in claim 5, wherein the Y shaped feeding tube comprises a root connected to the hopper, a first branch connected to the first container, and a second branch connected to the second container, the magnesium containing particles are suctioned to go through the first branch, the carbon nanotubes are suctioned to go through the second branch, the magnesium containing particles and the carbon nanotubes are mixed in the root.

7. A method of fabrication for a magnesium-based carbon nanotube composite material, the method comprising steps of:

providing solid magnesium containing particles and carbon nanotubes;

suctioning the solid magnesium containing particles and the carbon nanotubes separated from the magnesium containing particles into one and the same hopper of a feeding device, the hopper being disposed outside of a thixomolding machine;

mixing the solid magnesium containing particles and the carbon nanotubes to form a mixture of the solid magnesium containing particles and the carbon nanotubes in the hopper;

supplying the mixture into the thixomolding machine after the step of mixing the solid magnesium containing particles and the carbon nanotubes;

heating the mixture to form a semi-solid-state paste in the thixomolding machine; and cooling the semi-solid-state paste.

8. The method as claimed in claim 7, wherein a material of the solid magnesium containing particles is magnesium or magnesium-based alloy.

9. The method as claimed in claim 8, wherein the magnesium-based alloy comprises magnesium and other elements selected from the group consisting of zinc, manganese, aluminum, zirconium, thorium, lithium, silver, calcium, and any combination thereof.

10. The method as claimed in claim 7, wherein a diameter of the solid magnesium containing particles is in an approximate range from 20 nanometers to 100 microns.

11. The method as claimed in claim 7, wherein the solid magnesium containing particles and the carbon nanotubes are separately suctioned by using an air pump and introduced into the hopper at the same time.

12. The method as claimed in claim 7, wherein the semi-solid-state paste is stirred by a plunger.

13. The method as claimed in claim 12, wherein the semi-solid-state paste is injected into a die by the plunger.

14. The method as claimed in claim 7, wherein the thixomolding machine comprises:

a heating barrel;

a feeding inlet;

a nozzle;

a heating portion; and a plunger;

wherein the heating barrel comprises a first end and a second end; the feeding inlet is disposed at the first end; the nozzle is disposed at the second end; the heating portion is adjacent to the heating barrel; and the plunger is disposed within the heating barrel.

15. The method as claimed in claim 7, wherein the solid magnesium containing particles are all solid particles before being supplied to the thixomolding machine.

16. A method of fabrication for a magnesium-based carbon nanotube composite material, the method comprising steps of:

providing magnesium containing particles and carbon nanotubes;

suctioning the magnesium containing particles and the carbon nanotubes separated from the magnesium containing particles into one and the same hopper of a feeding device, the hopper being disposed outside of a thixomolding machine;

controlling a flow of the magnesium containing particles and a flow of the carbon nanotubes suctioning into the one and the same hopper;

mixing the magnesium containing particles and the carbon nanotubes to form a mixture of the solid magnesium containing particles and the carbon nanotubes in the hopper;

supplying the mixture into the thixomolding machine after the step of mixing the magnesium containing particles and the carbon nanotubes in the hopper;

heating the mixture to form a semi-solid-state paste in the thixomolding machine; and cooling the semi-solid-state paste.

17. The method as claimed in claim 16, wherein the magnesium containing particles are all solid particles when mixing with the carbon nanotubes.

18. The method as claimed in claim 16, wherein the magnesium containing particles are suctioned to go from a first container, through a Y shaped feeding tube, into the hopper, and the carbon nanotubes are suctioned to go from a second container, through the Y shaped feeding tube, into the hopper, the Y shaped feeding tube connecting the hopper with the first container and the second container.

19. The method as claimed in claim 18, wherein the Y shaped feeding tube comprising a root connected to the hopper, a first branch connected to the first container, and a second branch connected to the second container, the magnesium containing particles are suctioned to go through the first branch, the carbon nanotubes are suctioned to go through the second branch, the magnesium containing particles and the carbon nanotubes are mixed in the root.

20. The method as claimed in claim 19, wherein a first valve is disposed on the first branch to control the flow of the magnesium containing particles, a second valve is disposed on the second branch to control the flow of the carbon nanotubes.

* * * * *